US006132557A

United States Patent [19]

Takeuchi et al.

[11] Patent Number: 6,132,557

[45] Date of Patent: Oct. 17, 2000

[54] WATER-DISINTEGRATABLE FIBROUS SHEET CONTAINING FIBERS HAVING DIFFERENT FIBER LENGTHS AND PROCESS FOR PRODUCING THE SAME

[75] Inventors: Naohito Takeuchi; Takayoshi Konishi, both of Kagawa, Japan

[73] Assignee: Uni-Charm Corporation, Ehime, Japan

[21] Appl. No.: 09/148,663

[22] Filed: Sep. 4, 1998

[30] Foreign Application Priority Data

Sep. 8, 1997 [JP] Japan ..... 9-242640

[51] Int. Cl.[7] ..... D21H 11/00

[52] U.S. Cl. ..... 162/141; 162/146; 162/149; 162/158; 162/177; 162/181.1; 162/181.2; 162/183

[58] Field of Search ..... 162/146, 141, 162/149, 135, 177, 176, 181.2, 181.1, 183, 158

[56] References Cited

U.S. PATENT DOCUMENTS

| | | |
|---|---|---|
| 4,610,761 | 9/1986 | Eklund et al. . |
| 5,281,306 | 1/1994 | Kakiuchi et al. . |
| 5,487,813 | 1/1996 | Vinson et al. . |
| 5,526,607 | 6/1996 | Roesch et al. . |
| 5,849,153 | 12/1998 | Ishino et al. ..... 162/146 |

FOREIGN PATENT DOCUMENTS

| | | |
|---|---|---|
| 2095554 | 8/1994 | Canada . |
| 0802282 | 10/1997 | European Pat. Off. . |
| H1-168999 | 7/1989 | Japan . |
| 2-221489 | 9/1990 | Japan . |
| H2-229295 | 9/1990 | Japan . |
| 4-240296 | 8/1992 | Japan . |
| 6-220793 | 8/1994 | Japan . |
| H7-24636 | 3/1995 | Japan . |
| H9-132896 | 5/1997 | Japan . |
| H9-132897 | 5/1997 | Japan . |
| 2 119 272 | 11/1983 | United Kingdom . |

OTHER PUBLICATIONS

James E. Kline, "Paper and Paperboard"1981, pp. 31–128.

*Primary Examiner*—Peter Chin
*Attorney, Agent, or Firm*—Koda & Androlia

[57] ABSTRACT

A water-disintegratable fibrous sheet comprising a web of fibers comprising pulp of hardwood and pulp of conifer, pulp of conifer having a fiber length longer than that of the pulp of hardwood, and a water-insoluble or water-swellable binder being contained in the web to bind the fibers, is disclosed. The fibrous sheet is excellent in water-disintegratability and has sufficient strength for withstanding practical use. Furthermore, since excellent water-disintegratability and strength can be obtained without using a water-soluble binder, a production process of the fibrous sheet can be made simple.

8 Claims, No Drawings

WATER-DISINTEGRATABLE FIBROUS SHEET CONTAINING FIBERS HAVING DIFFERENT FIBER LENGTHS AND PROCESS FOR PRODUCING THE SAME

FIELD OF THE INVENTION

The present invention relates to a water-disintegratable fibrous sheet that is easily dispersed by a water flow and to a process for producing the same. More particularly, it relates to a water-disintegratable fibrous sheet that is excellent in water-disintegratability and strength and can be produced by a simple process and to a process for producing the same.

BACKGROUND OF THE INVENTION

Fibrous sheets are used for cleansing human skin, e.g., skin around anus, or cleaning a toilet room. The fibrous sheet is preferably water-disintegratable to be thrown away and drained in a toilet as it is. If it is not excellent in water-disintegratability, it requires a long time to be dispersed in a septic tank, and brings danger of clogging drainpipes of a toilet, when being thrown away and drained in a toilet. However, in general, a packed fibrous sheet impregnated with a cleansing liquid or the like has to be strong enough to endure conducting wiping operations while being impregnated with a cleansing liquid, and at the same time, has to keep water-disintegratability in the event of being thrown away and drained in a toilet. Therefore, a water-disintegratable fibrous sheet that has good water-disintegratability and strength sufficient to use is demanded.

Unexamined Published Japanese Patent Application No. 1-168999 discloses an easily water-dispersible cleaning product containing water-insoluble carboxymethylated pulp in a salt form of calcium. However, when a large amount of water-insoluble carboxymethylated pulp is used to improve strength, water-disintegratability is deteriorated.

Unexamined Published Japanese Patent Application No 2-229295 discloses a water-disintegratable paper containing a water-soluble binder having a carboxyl group and a metal. Examined Published Japanese Patent Application No. 7-24636 discloses a water-disintegratable cleaning product containing a water-soluble binder having a carboxyl group, a metallic ion and an organic solvent. However, this water-soluble binder cannot be mixed with fibers in water in a production process because of water-solubility thereof, so that the water-soluble binder has to be added to a fibrous sheet after paper manufacturing by means of spraying or the like and the production process is complicated disadvantageously.

Unexamined Published Japanese Patent Applications No. 9-132896 and No. 9-132897 each discloses a water-disintegratable sheet, in which sodium carbonate is added to water-insoluble or water-swellable carboxymethyl cellulose. However, this water-disintegratable sheet is insufficient in water-disintegratability.

SUMMARY OF THE INVENTION

An object of the present invention is to provide a fibrous sheet that is excellent in water-disintegratability and has strength sufficient to resist practical use.

Another object of the present invention is to provide a fibrous sheet that can be produced by a simple process.

The present invention provides a water-disintegratable fibrous sheet comprising a web of fibers comprising pulp of hardwood and pulp of conifer, and a water-insoluble or water-swellable binder being contained in the web to bind the fibers.

The water-disintegratable fibrous sheet of the present invention can be produced by a process comprising:

a step of mixing fibers comprising pulp of hardwood, fibers comprising pulp of conifer and a water-insoluble or water-swellable binder in water to obtain a liquid containing the fibers and the binder; and a step of subjecting the liquid to paper manufacturing to produce a fibrous sheet, the fibers forming a web and the binder being contained in the web to bind the fibers.

DETAILED DESCRIPTION OF THE INVENTION

A water-disintegratable fibrous sheet of the present invention is described in detail below.

Pulp of conifer used in the present invention is pulp produced from conifer as a raw material. Representative examples of the pulp of conifer include bleached kraft pulp of conifer, and kraft pulp of conifer is also included.

Pulp of hardwood used in the present invention is pulp produced from hardwood as a raw material. Representative examples of the pulp of hardwood include bleached kraft pulp of hardwood, and kraft pulp of hardwood is also included.

Average fiber lengths (hereinafter, referred to as a "fiber length") of the pulp of hardwood and pulp of conifer are different from each other. The fiber length of the pulp of hardwood is shorter than that of the pulp of conifer. By using the fibers having different fiber lengths in mixture, a fibrous sheet having excellent water-disintegratability can be produced.

The reason why water-disintegratability can be improved by adding the pulp of hardwood to the pulp of conifer is as follows. The pulp of conifer is subjected to a beating treatment, whereby fibrillated fibers can be strongly bonded to each other by hydrogen bonds. However, by adding the pulp of hardwood therein, which has weak bonding strength due to the shorter fiber length, unevenness in binding power of cellulose molecules arises. Therefore, the fibrous sheet is smoothly dispersed under the presence of a large amount of water with excellent dispersibility.

The term "dispersibility" used herein has the same meaning as water-disintegratability, i.e., property of being divided into minute parts upon contacting a large amount of water.

The fibers used in the present invention mainly comprise the pulp of conifer and pulp of hardwood as described above, and may further contain natural fibers such as cotton, synthetic fibers such as rayon, polypropylene, polyvinyl alcohol, polyesters and polyacrylonitrile, synthetic pulp made of polyethylene, and inorganic fibers such as glass wool. Those fibers are formed into a web. The term "web" used herein means a sheet-formed lump of fibers where directions of the fibers are arranged to some extent.

The basis weight of the web in the fibrous sheet is preferably from 10 to 100 g/m$^2$. When the basis weight is less than the lower limit, strength necessary for wiping operations cannot be obtained. When the basis weight is more than the upper limit, flexibility desirable in the fibrous sheet is lost. When the fibrous sheet is used for wiping skin e.g., skin around anus, or cleaning a damageable object, the basis weight of the web is more preferably from 20 to 60 g/m$^2$ from the viewpoints of strength and softness.

In the present invention, an amount of the pulp of hardwood is preferably 60% by weight or less based on a weight of the web. When an amount of the pulp of hardwood is more than the upper limit, strength of the fibrous sheet is insufficient to withstand the practical use such as wiping operations. An amount of the pulp of hardwood is more preferably from 10 to 50% by weight based on a weight of the web. When an amount of the pulp of hardwood is within the above range, strength and water-disintegratability are excellent.

In the water-disintegratable fibrous sheet of the present invention, a water-insoluble or water-swellable binder is added to improve strength of the fibrous sheet. Even when the binder is water-insoluble, the fibrous sheet can be easily dispersed in water due to the different fiber lengths. When the binder is water-swellable, the fibrous sheet can be dispersed more easily, because the binding strength of the water-swellable binder to the fibers is weakened by water-absorbing and swelling thereof.

In the present invention, water-insoluble or water-swellable carboxymethyl cellulose is preferred as the binder. Solubility of carboxymethyl cellulose differs in accordance with a degree of etherification (DS), pH and so on. The water-insoluble or water-swellable carboxymethyl cellulose used in the present invention has a degree of etherification of from 0.3 to 0.6 and pH of 5.0 or more.

What is called carboxymethylated pulp is included in the carboxymethyl cellulose. The carboxymethylated pulp can be also used as the water-insoluble or water-swellable binder in the present invention. The carboxymethylated pulp is in various salt forms, such as an acid type, a sodium salt, a calcium salt, an aluminum salt, a barium salt, a zinc salt, a copper salt and a manganese salt, and the carboxymethylated pulp can be used in any salt forms in the present invention.

In general, to produce a fibrous sheet containing a binder for binding fibers therein, a step of adding the binder to the fibrous sheet is required. For example, in the case where a water-soluble binder is used, a solution in which the binder is dissolved in water or an organic solvent has to be prepared and then added to a previously formed web of fibers by spraying or the like. However, in the case where the water-insoluble or water-swellable binder is used, the binder can be added to fibers in water before forming a web, and thus a fibrous sheet can easily be produced. That is, when the water-insoluble or water-swellable binder is used as a binder, any particular step only to add the binder is not necessary in a production process of the fibrous sheet.

Therefore, the water-disintegratable fibrous sheet of the present invention can be produced by a process comprising:

a step of mixing fibers comprising pulp of hardwood, fibers comprising pulp of conifer and a water-insoluble or water-swellable binder in water to obtain a liquid containing the fibers and the binder; and a step of subjecting the liquid to paper manufacturing to produce a fibrous sheet, the fibers forming a web and the binder being contained in the web to bind the fibers.

In the above-mentioned step of mixing, when the carboxymethyl cellulose is used as the water-insoluble or water-swellable binder, a mixing ratio of the fibers comprising the pulp of hardwood and the pulp of conifer to the carboxymethyl cellulose is preferably from 98/2 to 55/45 by weight, and more preferably from 98/2 to 80/20 by weight.

In the case where the liquid containing the fibers and the carboxymethyl cellulose in mixture is paper manufactured into the fibrous sheet by using cylinder mold or slant short wire, the carboxymethyl cellulose is sometimes dropped off through the cylinder mold or slant short wire due to the small size of the carboxymethyl cellulose. Accordingly, it is difficult to determine the resulting mixing ratio of the carboxymethyl cellulose in the fibrous sheet after paper manufacturing. However, the water-disintegratable fibrous sheet obtained in the above-described preferred mixing ratio in the step of mixing exhibits well-balanced water-disintegratability and strength, as a result. When the content of the carboxymethyl cellulose is higher than the upper limit, the water-disintegratability is lowered.

As described above, in the water-disintegratable fibrous sheet of the present invention, even though the water-insoluble or water-swellable binder, which is more difficult to disperse in water compared with the water-soluble binder, is used, excellent water-disintegratability can be obtained by adding the fibers of the pulp of hardwood to the fibers of the pulp of conifer. And the water-insoluble or water-swellable binder can advantageously simplify the production process of the water-disintegratable fibrous sheet.

In the present invention, further more, sodium carbonate and/or sodium hydrogencarbonate is preferably added to the fibrous sheet, when the water-insoluble or water-swellable carboxymethyl cellulose is used as the binder. Addition of the sodium carbonate and/or sodium hydrogencarbonate is preferably in the step of mixing in the production process. The sodium carbonate and/or sodium hydrogencarbonate can enhance water-dispersibility of the carboxymethyl cellulose. Thus, the water-insoluble or water-swellable carboxymethyl cellulose can be uniformly dispersed in the liquid, so that the resulting fibrous sheet can contain the carboxymethyl cellulose uniformly therein. Specifically, the water-insoluble carboxymethyl cellulose is preferably added with the sodium carbonate and/or sodium hydrogencarbonate, because it is inferior in water-dispersibility to the water-swellable carboxymethyl cellulose and is more difficult to be uniformly dispersed in the liquid.

Incidentally, if the water-dispersibility is excessively enhanced, the water-insoluble or water-swellable carboxymethyl cellulose is substantially changed to water-soluble carboxymethyl cellulose which is impossible to be mixed with the fibers in water. Thus, an added amount of the sodium carbonate and/or sodium hydrogencarbonate has to be limited to such an extent that the water-insoluble or water-swellable carboxymethyl cellulose is not substantially changed to a water-soluble carboxymethyl cellulose, namely, such an extent that the carboxymethyl cellulose can be mixed with the fibers in water.

The fibrous sheet of the present invention can be used both in a dry state and in a wet state for wiping operations. When the fibrous sheet is used in a wet state, the fibrous sheet has to be prevented from water-disintegrating by water contained therein during wiping operations and also has to keep wet strength therein sufficient to endure wiping operations.

Therefore, in the case where the carboxymethyl cellulose is used as the binder and the fibrous sheet is used in a wet state, a metallic salt that crosslinks the carboxymethyl cellulose is preferably added to the fibrous sheet. Wet strength of the fibrous sheet can be increased by crosslinking with the metallic salt.

Examples of the metallic salt include salts of magnesium, calcium, barium, strontium, manganese, zinc, cobalt and nickel. Among these, at least one metallic salt selected from the group consisting of salts of calcium, zinc and magnesium is preferably used. By using these salts, wet strength of the fibrous sheet can be improved.

In the case where the metallic salt is selected from the salts of magnesium, calcium, barium, strontium, manganese, zinc, cobalt and nickel, 0.5 g or more of the metallic salt is preferably added to 100 g of the web. When an amount of the metallic salt is less than the above amount, wet strength of the fibrous sheet is not sufficient to the wiping operations.

Also, in the case where the carboxymethyl cellulose is used as the binder and the fibrous sheet is used in a wet state, the fibrous sheet is preferably impregnated with an organic solvent. The organic solvent can increase wet strength of the fibrous sheet, as well. Examples of the organic solvent include a monohydric alcohol such as ethanol and isopropyl alcohol, and a polyhydric alcohol such as propylene glycol, polyethylene glycol and propylene glycol monomethyl ether.

The organic solvent is preferably added to the fibrous sheet in an amount of from 5 to 95 g per 100 g of the web from the standpoint of wet strength. The organic solvent is more preferably added in an amount of from 5 to 60 g to prevent deterioration of use feeling and rough dry skin of a user.

In the water-disintegratable fibrous sheet of the present invention, other materials may be added if they do not spoil the effects of the present invention. For example, a surfactant, a disinfectant, a preservative, a deodorizer, a moistening agent, an alcohol and the like can be added. These materials may be added to the above-mentioned organic solvent or water, so as to improve the fibrous sheet.

The water-disintegratable fibrous sheet of the present invention can be used as wet-type tissue paper, for example, for wiping skin around anus and for cleaning a toilet room. When the water-disintegratable fibrous sheet of the present invention is packed as a product while being previously wetted, it is sold in a sealed state to prevent the fibrous sheet from drying.

Alternatively, the water-disintegratable fibrous sheet of the present invention may be sold in a dry state to be impregnated with water or the like, upon use.

Furthermore, the fibrous sheet of the present invention may have a multilayer structure, where plural fibrous layers are laminated.

For example, a fibrous layer comprising pulp of conifer without the pulp of hardwood may be laminated onto another fibrous layer comprising the pulp of hardwood, the pulp of conifer and the water-insoluble or water-swellable binder. In this case, the fibrous layer without the pulp of hardwood may contain the binder, or may not contain the binder to enhance water-disintegratability therein. When both the fibrous layer contain the binder and the binder is the water-insoluble or water-swellable carboxymethyl cellulose, sodium carbonate and/or sodium hydrogencarbonate is preferably added only to the fibrous layer without the pulp of hardwood, so as to enhance water-dispersibility of the carboxymethyl cellulose therein. Thus, the fibrous layer containing the pulp of hardwood has excellent water-disintegratability due to the pulp of hardwood, and the fibrous layer without the pulp of hardwood also has excellent water-disintegratability due to the carboxymethyl cellulose having good water-dispersibility.

Alternatively, any fibrous layers may contain the pulp of hardwood in different mixing ratios to the pulp of conifer. Water-disintegratability in each of the layers can be controlled in a similar way to described-above.

Incidentally, the binder used in the present invention is not restricted to the water-insoluble or water-swellable carboxymethyl cellulose. Any binder can be used if it is water-insoluble or water-swellable. For example, water-insoluble polyvinyl alcohol can be used.

The present invention is described in more detail by referring to the Examples, but the present invention is not construed as being limited to the Examples.

EXAMPLE 1

Bleached kraft pulp of conifer (i.e., NBKP) with a CSF (Canadian Standard Freeness) of 570 ml and bleached kraft pulp of hardwood (i.e., LBKP) with a CSF (Canadian Standard Freeness) of 720 ml were used as fibers. Water-insoluble carboxymethyl cellulose (carboxymethyl cellulose chicorate produced by Nichirin Chemical Industries, Ltd., DS: 0.42, pH 5.8) was used as a water-insoluble or water-swellable binder.

The bleached kraft pulp of conifer, the bleached kraft pulp of hardwood and the carboxymethyl cellulose were mixed with water. The mixing ratio by weight of the fibers to the binder, i.e., the total weight of the bleached kraft pulp of conifer and the bleached kraft pulp of hardwood to the weight of the carboxymethyl cellulose, was 95 to 5. The resulting liquid containing the fibers and the binder dispersed therein was used as a raw material for Example 1-1. Furthermore, another raw material for Example 1-2 was also prepared from the same liquid, except for adding 50 g of sodium carbonate per 100 g of the carboxymethyl cellulose therein.

The raw materials for Examples 1-1 and 1-2 were allowed to stand and then each manufactured into a water-disintegratable fibrous sheet having a basis weight of 22.5 g/m$^2$ and a crape ratio of 40%, by using a paper machine (Yankee machine with slant short wire).

The resulting fibrous sheets were impregnated with a solution obtained by mixing propylene glycol monomethyl ether, calcium chloride and water in a ratio of 20/0.5/79.5 in an amount of 200 g per 100 g of the fibrous sheet.

The fibrous sheets thus impregnated were then allowed to stand at 20° C. for 24 hours and then measured for water-disintegratability and wet strength.

Water-disintegratability was measured according to the test of water-disintegratability of toilet paper regulated under JIS (Japanese Industrial Standard) P4501. Specifically, a specimen obtained by cutting the water-disintegratable fibrous sheet into a square of 10 cm×10 cm was put in a beaker containing 300 ml of ion-exchanged water, followed by stirring with a rotor. The rotational speed was 600 r.p.m. The state of dispersion of the fibrous sheet was continuously observed, and the time required for completion of dispersion was measured. (The results are shown in tables with a unit of second.)

Wet strength was measured in such a manner that the above-obtained fibrous sheet was cut to a test piece having a dimension of 25 mm width and 150 mm length, and wet strength of the test piece was measured with a Tensilon test machine at a chuck distance of 100 mm and a tensile speed of 100 mm/min. Wet strength was measured in both the machine direction (MD) and the cross direction (CD) of the fibrous sheet. Strength at breakage (gf) was taken as a test result of wet strength. (In the Tables, the results are shown in terms of g/25mm.)

For a comparative example, a fibrous sheet was manufactured in the same manner as in Example 1 from the same raw materials as in Example 1-1 except for using the bleached kraft pulp of conifer only without the bleached kraft pulp of hardwood. The resulting fibrous sheet was impregnated with the same solution as in Example 1 in an amount of 200 g per 100 g of the fibrous sheet in the same manner as in Example 1. The fibrous sheet thus impregnated was measured for water-disintegratability and wet strength in the same manner as in Example 1.

The results obtained are shown in Table 1.

TABLE 1

| | Example 1-1 | Example 1-2 | Comparative Example |
|---|---|---|---|
| Added amount of NBKP (% by weight) | 50 | 50 | 100 |
| Added amount of LBKP (% by weight) | 50 | 50 | 0 |
| sodium carbonate | none | added | none |
| Water-disintegratability (second) | 56 | 32 | 106 |
| Wet Strength of MD (g/25 mm) | 98 | 145 | 139 |
| Wet Strength of CD (g/25 mm) | 52 | 77 | 80 |

It is understood from the results in Table 1 that the water-disintegratable fibrous sheets containing bleached kraft pulp of hardwood are excellent in water-disintegratability.

EXAMPLE 2

As similar to Example 1, the bleached kraft pulp of conifer (NBKP), the bleached kraft pulp of hardwood (LBKP) and the carboxymethyl cellulose were mixed with water, and 200 g of sodium carbonate per 100 g of the carboxymethyl cellulose was added to the liquid containing the fibers and the carboxymethyl cellulose dispersed therein. At this time, several raw materials were prepared with varying an added amount of the bleached kraft pulp of hardwood to an amount of the bleached kraft pulp of conifer. The mixing ratio by weight of the fibers to the binder, i.e., the total weight of the bleached kraft pulp of conifer and the bleached kraft pulp of hardwood to the weight of the carboxymethyl cellulose, was 95/5. The contents of the bleached kraft pulp of conifer and the bleached kraft pulp of hardwood based on the total weight of the fibers are each shown in Examples 2-1, 2-2, 2-3, 2-4 and 2-5 in Table 2 (% by weight).

The raw materials were allowed to stand and then each manufactured into a fibrous sheet having a basis weight of 22.5 g/m$^2$ and a crape ratio of 40% in the same manner as in Example 1.

The resulting fibrous sheets were impregnated with a solution containing polypropylene glycol monomethyl ether and calcium chloride in the same manner as in Example 1.

The fibrous sheets thus impregnated were allowed to stand at 20° C. for 24 hours and then measured for water-disintegratability and wet strength in the same manner as in Example 1.

For a comparative example, a fibrous sheet was manufactured in the same manner as in Example 2 from the same raw materials as in Example 2 with 200 g of sodium carbonate per 100 g of the carboxymethyl cellulose added therein, except for using the bleached kraft pulp of conifer only without the bleached kraft pulp of hardwood. The resulting fibrous sheet was impregnated with the same solution as in Example 2 in an amount of 200 g per 100 g of the fibrous sheet. The fibrous sheet thus impregnated was measured for water-disintegratability and wet strength in the same manner as in Example 2.

The results obtained are shown in Table 2.

TABLE 2

| | Example 2-1 | Example 2-2 | Example 2-3 | Example 2-4 | Example 2-5 | Comparative Example |
|---|---|---|---|---|---|---|
| Added amount of NBKP (% by weight) | 90 | 80 | 70 | 60 | 50 | 100 |
| Added amount of LBKP (% by weight) | 10 | 20 | 30 | 40 | 50 | 0 |
| Water-disintegratability (second) | 77 | 71 | 66 | 61 | 53 | 81 |
| Wet Strength of MD (g/25 mm) | 116 | 104 | 95 | 90 | 81 | 137 |
| Wet Strength of CD (g/25 mm) | 73 | 68 | 64 | 59 | 52 | 86 |

While the present invention has been described in detail and with reference to specific embodiments thereof, it will be apparent to one skilled in the art that various changes and modifications can be made therein without departing from the spirit and scope thereof.

What is claimed is:

1. A wet water-disintegratable cleaning sheet used in wet conditions comprising a web of fibers comprising pulp of hardwood and pulp of conifer, a water-insoluble or water-swellable binder contained in the web to bind the fibers, at least one compound selected from the group consisting of sodium carbonate and sodium hydrogen carbonate added thereto, and a metallic salt and wet with an organic solvent, and wherein:

said water-insoluble or water-swellable binder is carboxymethyl cellulose having a degree of etherification (DS) of from 0.3 to 0.6 and a pH of 5.0 or more;

said metallic salt is at least one compound selected from the group consisting of salts of calcium, zinc and magnesium;

said organic solvent is at least one compound selected from the group consisting of a monohydric alcohol and a polyhydric alcohol;

an amount of said pulp of hardwood ranges from 10–50% by weight based upon a weight of said web;

a basis weight of the web is 20–60 g/m$^2$;

a wet strength of the cleaning sheet in machine direction (MD) is 81 g/25 mm or higher and in cross direction (CD) is 52 g/25 mm or higher; and a water-disintegratability of the cleaning sheet is 77 seconds or shorter.

2. A water-disintegratable fibrous cleaning sheet as claimed in claim 1, wherein said pulp of hardwood is bleached kraft pulp of hardwood, and said pulp of conifer is bleached kraft pulp of conifer.

3. A water-disintegratable fibrous sheet as claimed in claim 1, wherein said pulp of hardwood is bleached kraft pulp of hardwood, and said pulp of conifer is bleached kraft pulp of conifer.

4. A water-disintegratable fibrous cleaning sheet as claimed in claim 1, wherein the content of the metallic salt is 0.5 g or more based on 100 g of the web.

5. A water-disintegratable fibrous cleaning sheet as claimed in claim 1, wherein the organic solvent is at least one compound selected from the group consisting of ethanol, isopropyl alcohol, propylene glycol, polyethylene glycol and propylene glycol monomethyl ether.

6. A water-disintegratable fibrous cleaning sheet as claimed in claim 5, wherein the content of the organic solvent is 5 to 95 g based on 100 g of the web.

7. A water-disintegratable fibrous cleaning sheet as claimed in claim 1, further comprising at least one compound selected from the group consisting of surfactant disinfectant preservative, deodorizer, moistening agent and alcohol.

8. A process for producing a wet water-disintegratable cleaning sheet used in wet conditions comprising:

a step of mixing fibers comprising pulp of hardwood, fibers comprising pulp of conifer and a water-insoluble or water-swellable binder in water to obtain a liquid containing the fibers and the binder;

a step of subjecting the liquid to paper manufacturing to produce a fibrous sheet, the fibers forming a web and the binder being contained in the web to bind the fibers; and a step of impregnating said fibrous sheet with a solution comprising a metallic salt, an organic solvent and water; and wherein:

said fibrous sheet is wet with said organic solvent;

said water-insoluble or water-swellable binder comprises carboxymethyl cellulose having a degree of etherification (DS) of from 0.3 to 0.6 and a pH of 5.0 or more;

at least one compound selected from the group consisting of sodium carbonate and sodium hydrogen carbonate is added to said liquid;

an amount of said pulp of hard wood ranges from 10–50% by weight based upon a weight of said web;

in the step of mixing, a mixing ratio of said fibers to said carboxymethyl cellulose is from 98/2 to 55/45 by weight;

a basis weight of the web is 20–60 $g/m^2$;

a wet strength of the cleaning sheet in machine direction (MD) is 81 g/25 mm or higher and in cross direction (CD) is 52 g/25 mm or higher; and a water-disintegratability of the cleaning sheet is 77 seconds or shorter.

* * * * *